United States Patent [19]

Westrom

[11] 4,216,627

[45] Aug. 12, 1980

[54] SHEAR SHARPENER

[76] Inventor: Stanley J. Westrom, 25 NW. 44th Ave., Des Moines, Iowa

[21] Appl. No.: 957,015

[22] Filed: Nov. 2, 1978

[51] Int. Cl.[3] ..... B24B 3/52

[52] U.S. Cl. ..... 51/69

[58] Field of Search ..... 51/68, 69, 157, 158, 51/218 A, 218 R

[56] References Cited

U.S. PATENT DOCUMENTS

| | | | |
|---|---|---|---|
| 961,010 | 6/1910 | Poitras | 51/69 |
| 1,148,303 | 7/1915 | Farrar | 51/69 |
| 1,459,580 | 6/1923 | Downey | 51/69 |
| 1,860,404 | 5/1932 | Carter | 51/69 X |
| 2,557,093 | 6/1951 | Carbarino | 51/69 X |

*Primary Examiner*—Harold D. Whitehead

*Attorney, Agent, or Firm*—Henderson & Sturm

[57] ABSTRACT

A shear sharpener in which receiptrocatable and laterally swingable home means is mounted above a vise means having improved clamping and locking means to assure accurate honing of shear blades.

4 Claims, 4 Drawing Figures

SHEAR SHARPENER

DESCRIPTION

TECHNICAL FIELD

Means for sharpening cutting blades, particular shear blades such as found in conventional scissors where the blade is sharpened at one angle as distinguished from sharpening at both sides of the blade as in the conventional knife.

BACKGROUND OF THE INVENTION

Many shear honing devices are known, all having one or more defects militating against accurate sharpening; e.g., deficient clamp means for holding the blade securely in proper position; lack of versatility as respects ability to handle blades of differing characteristics; high cost; problems as to maintenance and easy replacement of wearing parts; lack of convenience in use; cumbersome construction preventing easy knock-down for shipment and simple assembly for use; etc.

DISCLOSURE OF INVENTION

Provided according to the invention is an assembly of elements including a base, a pair of socket means, a swivel carried by one socket means, a vise carried by the other socket means for holding a shear blade, and hone means supported and guided by the swivel means for appropriate movement to hone the shear blade held by the vise means. The swivel means is selectively vertically adjustable to select a path or reciprocation of the hone means to accommodate the particular blade angle. The vise means is securely lockable in its socket means so as to prevent accidental movement of the vise means during the honing operation. Also provided is a high-rise attachment for mounting the vise means in an elevated position to accommodate shear blades of special design, such as the well-known Wiss blade.

BEST MODE FOR CARRYING OUT THE INVENTION

Figures 1, 2, 3, 4:
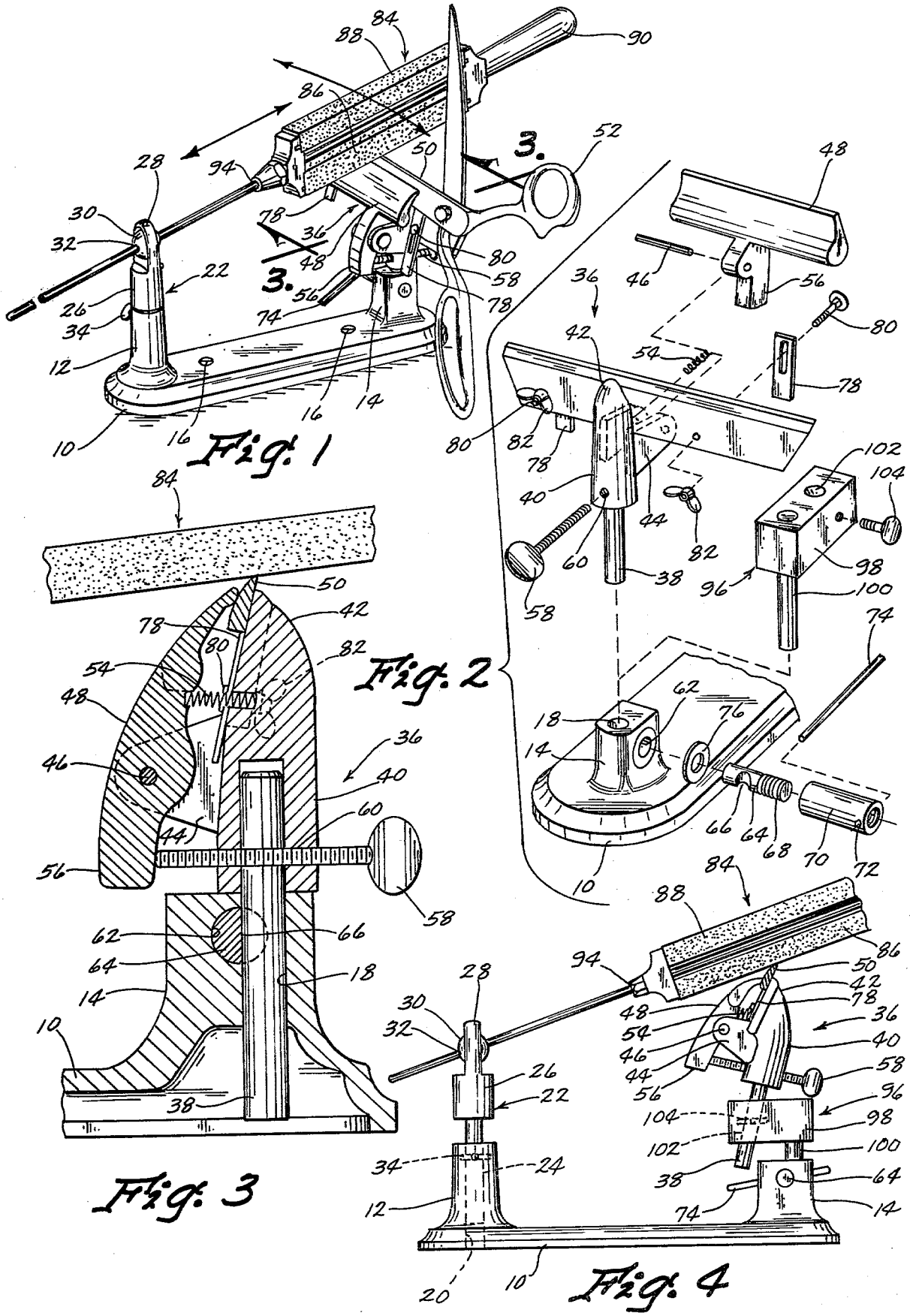
FIG. 1 is a perspective of the sharpener.
FIG. 2 is an "exploded" perspective on a larger scale and as seen from the opposite side of FIG. 1.
FIG. 3 is a section through a vertical plane denoted by the line 3—3 in FIG. 1.
FIG. 4 is an elevation on about the scale of FIG. 1 and illustrating the high-rise attachment.

The base of the sharpener is designated by the numeral 10. It may best be referred to as elongated in a horizontal direction and has first and second socket means 12 and 14, respectively, spaced apart lengthwise of the base. Holes 16 are provided in the base for the receipt of screws or the like (not shown) for affixation of the base to a work bench, table or the like (also not shown). The base is preferably of cast aluminum or the like for strength and lightweight. Each socket means is in the form of a vertical bore formed in a pedestal cast integrally with the base. The bore for the socket means 14 appears at 18 in FIGS. 2 and 3. The other socket means bore is shown in dotted lines at 20 in FIG. 4.

The socket means 12 carries a swivel means denoted in its entirety at 22. This means includes a lower part in the form of a short shaft or post 24 depending into and received by the bore 20 (FIG. 4). Rigid with the lower part is an upper part 26 rising from the lower part and having an eye 28 in which is a captive ball 30 that constitutes a swivel element. The ball is rockable in the eye about a plurality of axes; i.e., it has substantially universal movement so as to be capable of occupying an almost infinite number of positions relative to the eye 28. The ball has a through bore or opening 32 (FIG. 1) for purposes to appear below. Further, the swivel means is selectively vertically adjustable in its socket means, the selected position being held by lock means including, for example, a thumb screw 34 threaded into the socket means 12 and engageable with the post 24 (FIG. 1). This adjustment will be explained in the description of the use and operation of the invention.

The socket means 14 at the opposite end of the base 10 carries vise means designated as a whole by the numeral 36. This means comprises a lower part or post 38 in the form of a short shaft axially received by the socket means bore 18 and an upper part 40, rigidly connected to the lower part and constituting a fixed vise jaw 42. The upper part 40 has a pair of apertured ears 44 rigid therewith, and a cross shaft 46 serves as a pivot for mounting a movable jaw 48; that is, the two jaws are relatively movable to open or close for accommodating a shear blade, as that at 50 as part of a typical pair of scissors 52. The jaws are biased to open position, here by a coiled compression spring 54. An integral depending tail 56 on the movable jaw is engaged by a clamp or lock means, preferably a thumb screw 58 which threads through a threaded bore 60 which may be formed in part in the fixed jaw and in part through the fixed jaw depending post 38 or in either part alone (FIG. 4). This type of connection establishes rigidity between the post and associated jaw.

As noted previously herein, it is important to the accuracy of the honing operation that the shear blade be securely held in position during that operation, because any interim change in position will severely affect that blade angle and edge. In the instant case, positive rigidity between the vise means and base is assured by improved locking means. As best seen in FIGS. 2 and 3, the socket means 14 is formed with a cross bore 62 which intersects the socket bore 18 (FIG. 3). A lock member 64, herein the form of a short shaft, is axially received by the bore 62, and this member has a semi-cylindrical key-way 66 formed therein so that the post 38 intersects a portion of the lock member. An exterior portion of this member is screw-threaded at 68 to threadedly receive a cooperative threaded exterior part or nut 70. A cross bore 72 in the nut receives a handle 74 for tightening and loosening the clamping relationship between the post 38 and lock member 64. When this means is tightened, the vise means is held rigid to the base and is incapable of changing position. A washer 76 may be used between the nut 70 and the exterior of the socket means 14.

In order that the shear blade to be sharpened may be accurately positioned in the vise means, the interior face of the movable jaw is provided with selectively adjustable and settable stop means, herein the form of a pair of slotted stops 78 and cooperative screws 80 and wing nuts 82. Setting of the stops determines the height to which the blade to be sharpened projects above the vise means jaws.

The sharpener includes hone means, designated in its entirety at 84 and comprising a pair of abrasive stones 86 and 88, a handle 90 and a shaft 92, all connected together in end-to-end fashion. The shaft is preferably removably connected to the stone assembly, as by a screw threaded connection at 94. This facilitates easy shipment of the sharpener, which is further facilitated because the swivel and vise means are removable from the base for simplified packaging.

The hone means shaft 92 is slidably received in the bore in the swivel ball 30, and when the blade to be sharpened is securely held in the vise means, the hone means may have both back and forth and lateral movement as indicated by the arrows in FIG. 1. The proper angle of the blade is determined by vertically adjusting the swivel means until the hone means lies flat across the angle, after which the thumb screw 34 is tightened. The "universal" mounting of the ball 30 permits considerable flexibility and versatility of the hone means during use. Of course, the hone means shaft is axially removable from the ball when not in use. The stones 86 and 88 are of different abrasive qualities; e.g., coarse and medium. Other grades may be selected.

Some shear blades, notably the well-known Wiss type, have cutting edges that require a higher position of the vise means as well as a different angle of the vise means relative to the vertical. For this purpose, the invention provides a high-rise attachment denoted as a whole at 96. This attachment comprises a member in the form of a block 98 having rigid thereon a depending post or shaft 98 which is received by the socket means bore 18 in lieu of the vise means post (FIG. 4). The high-rise post is secured by the lock means 64 and 70 just as in the case of the vise means post. A further element of the high-rise attachment is a generally upright bore 102 therein, which bore is inclined slightly away from the vertical (FIG. 4). This bore receives the vise means post 38, the position of which in the attachment is secured by clamp or lock means in the form of a thumb screw 104. As seen in FIG. 4, the vise means, when the attachment is used, is at a higher elevation as well as at an angle sloping away from the remote socket means 12 or in the direction of the hone means handle 90.

Industrial Applicability

It is believed that this, as well as the use and operation of the improved blade sharpener, will be clear from the foregoing. Once the proper adjustments have been made and secured, it is necessary only to move the hone means over the blade. The best use of the hone means includes a sliding thereof to the user's right, coupled with a slight forward movement. Each stone is usable on all four sides. The device is adjustable to accommodate any blade angle. Proper use of the hone means adds to blade life, because only enough metal is removed to attain a sharp edge. Use of the hone means will not remove the "set" of the blade, nor does it affect blade temper. Stroking of the blade by the hone means as aforesaid enables even sharpening of the blade over its entire length. The simplicity of the sharpener enables anyone to produce a professional job.

I claim:

1. A shear sharpener, comprising: a horizontally elongated base having first and second upwardly opening socket means spaced apart lengthwise of said base; swivel means having a lower part depending into and received by the first socket means and an upper part fixed to and rising from said lower part, said upper part including a swivel element mounted for movement about a plurality of intersecting axes and having a through opening on an axis spaced above the base; vise means including a post depending into and received by the second socket means, a fixed jaw rigid with and rising from the post, a movable jaw cooperative with the first jaw for receiving a shear blade between them and clamp means selectively operative to close and open the jaws; means for securely locking the vise means to the base via said post and second socket means with the jaws transverse to the base; and hone means disposed above the vise means and including a shaft slidably received by the opening in the swivel element, at least one honing stone fixed to the shaft as an elongation thereof, and a handle attached to the stone for manual reciprocation of the hone means across a shear blade held by the vise means, said swivel enabling said reciprocation of the hone means as well as movement of said hone means transversely of the base and also enabling vertical movement of the hone means relative to the vise for lifting of the hone means clear of the vise; and wherein the means for locking the vise means post to the base includes an opening in the base transverse to said second socket means and a releasable locking element received in said opening and having a key-way embracing the vise means post within said socket means.

2. A shear sharpener as defined in claim 1, in which the locking element has a screw-threaded portion exteriorly of said second socket means and a cooperative screw-threaded member combines with said portion to releaseably tighten the locking element in place.

3. A shear sharpener as defined in claim 2, including a high-rise attachment having a post receivable in the second socket means in substitution for the vise means post and lockable by the aforesaid locking means, said attachment itself having a substantially vertical socket means for receiving the vise means post at a higher elevation than when the attachment is not used; and means for locking the vise means post in the attachment socket means.

4. A shear sharpener as defined in claim 3, in which the socket means in the attachment is inclined to the vertical in the direction away from the first socket means so as to dispose the vise means at a different angle for the accommodation of shear blades having more acute angles.

* * * * *